US009629222B2

(12) United States Patent
Yao et al.

(10) Patent No.: US 9,629,222 B2
(45) Date of Patent: Apr. 18, 2017

(54) DIGITAL ADDRESSABLE LIGHTING INTERFACE SHORT PROTECTION CIRCUIT

(71) Applicant: General Electric Company, Schenectady, NY (US)

(72) Inventors: Gang Yao, East Cleveland, OH (US); Benoit Essiambre, Lachine (CA); Nina Rose Scheidegger, East Cleveland, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 307 days.

(21) Appl. No.: 14/469,787

(22) Filed: Aug. 27, 2014

(65) Prior Publication Data

US 2016/0066395 A1 Mar. 3, 2016

(51) Int. Cl.
*H05B 37/02* (2006.01)
*H05B 37/03* (2006.01)

(52) U.S. Cl.
CPC ..... *H05B 37/0254* (2013.01); *H05B 37/03* (2013.01)

(58) Field of Classification Search
CPC .... H05B 37/02; H05B 37/0254; H05B 33/08; H05B 33/0815; H05B 33/0851
USPC ..... 315/209 R, 224–226, 291, 307, 308
See application file for complete search history.

(56) References Cited

U.S. PATENT DOCUMENTS

2008/0258551 A1 10/2008 Chitta et al.
2009/0003417 A1 1/2009 Boeckle
2015/0015156 A1* 1/2015 Angelin ..... H05B 33/0851 315/210

FOREIGN PATENT DOCUMENTS

AT DE 102012206906 A1 * 10/2013 ..... H05B 37/0254
DE 102012206906 A1 10/2013

OTHER PUBLICATIONS

PCT Search Report and Written Opinion issued in connection with corresponding Application No. PCT/US2015/040678 on Nov. 13, 2015.

* cited by examiner

*Primary Examiner* — Jimmy Vu
(74) *Attorney, Agent, or Firm* — GE Global Patent Operation; Peter T. DiMauro

(57) ABSTRACT

A timing circuit may be enabled when a static signal disables communication through a communications bus, the timing circuit producing a threshold level after being enabled for a predetermined time period, and a switch controlled by the timing circuit is configured to disconnect the static signal when the timing circuit produces the threshold level. A static signal may be used to enable a timing circuit upon the static signal disabling communication through a communications bus, and communication may be allowed through the communication bus by disconnecting the static signal using a switch controlled by the timing circuit, after the timing circuit has been enabled for a predetermined period of time.

20 Claims, 4 Drawing Sheets

DIGITAL ADDRESSABLE LIGHTING INTERFACE SHORT PROTECTION CIRCUIT

The disclosed exemplary embodiments relate generally to lighting control systems, and more particularly to protection circuits for addressable lighting systems.

BACKGROUND

Lighting for homes, offices, commercial spaces, and public areas may be controlled to account for occupancy and ambient light at the light fixture, workstation, room, floor and building levels. Some systems have been implemented using the Digital Addressable Lighting Interface (DALI) which is a global standard for a lighting control data protocol and transport mechanism maintained as IEC 62386. The DALI standard specifies a two wire, bi-directional data bus connecting a DALI application controller with up to 64 DALI controlled devices, referred to as control gear, such as ballasts, occupancy sensors, photo sensors, wall switches, and dimmers. The data bus cable is mains rated and may be run next to mains conductors or in a cable with mains conductors. The DALI control gear are individually addressable and data is transferred between the application controller and the control gear using an asynchronous, half-duplex, serial protocol. Data is transmitted using Manchester encoding at a fixed data transfer rate of 1200 bits/s to ensure reliable communications. The DALI bi-directional data bus also provides power at 16 volts and 250 mA maximum current. DALI application controllers and control gear may be connected in a star or daisy chain configuration.

FIG. 1 shows a block diagram of an exemplary DALI system 100. An application controller 105 is connected to a number of control gear $\mathbf{110}_0$-$\mathbf{110}_{63}$ by the bi-directional data bus 115. Control gear 1100-11063 may control light sources 125 or other equipment or may be implemented as occupancy sensors, light sensors, wall switches or other lighting appliances. Mains power is provided through mains cable 120. In some implementations, mains power is provided by or controlled by application controller 105.

FIG. 2 shows a schematic diagram of at least a portion of an exemplary DALI control gear 205 similar to control gear $\mathbf{110}_0$-$\mathbf{110}_{63}$. DALI control gear 205 may include a bus interface 210 and operating circuitry 215. Bus interface 210 may isolate the operating circuitry 215 from the bi-directional data bus 115 using a diode bridge 240 and optocouplers. For example, optocoupler 220R may be used for receiving commands or messages from application controller 105 to the control gear 205, while optocoupler 220T may be used for transmitting responses and messages from the control gear 205 to the application controller 105. The control gear 205 may include a computer 225, for example, a single chip microcontroller with a processor and memory 230 for exchanging information over the DALI bi-directional data bus 115 and for controlling lamps and other lighting equipment.

However, with this type of architecture, where one or more signals of the control gear are effectively coupled directly to the communications bus, some circuitry failures in the control gear may be capable of disabling the communications bus. In some failure modes of the control gear 205, one or more inputs or outputs of the microcontroller 225 may be pulled to a low or ground state and may remain at that state until the failure mode is resolved. For example, the microcontroller 225 may fail, resulting in a transmit output 235 being forced to a low or ground state. In the exemplary control gear 205 shown in FIG. 2, this causes a static voltage to be applied across the LED of optocoupler 220T which in turn causes the driver side of the optocoupler 220T to remain in an "on" or conductive state. This effectively shorts the two wire bi-directional data bus 115 through the diode bridge 240. As a result, no messages or responses may be conducted between the application controller 105 and the control gear 205 or any other devices that may be connected to the bi-directional data bus 115. It would be advantageous to provide a mechanism to avoid these conditions.

SUMMARY

The disclosed embodiments are directed to an apparatus including a timing circuit enabled when a static signal disables communication through a communications bus, the timing circuit producing a threshold level after being enabled for a predetermined time period, and a switch controlled by the timing circuit and configured to disconnect the static signal when the timing circuit produces the threshold level.

The disclosed embodiments are directed to a method including using a static signal to enable a timing circuit upon the static signal disabling communication through a communications bus, and allowing communication through the communication bus by disconnecting the static signal using a switch controlled by the timing circuit, after the timing circuit has been enabled for a predetermined period of time.

DETAILED DESCRIPTION

The embodiments disclosed herein limit the time a signal may be held at a static level in the event of a failure. In one or more aspects, the present embodiments utilize a timing circuit and a switch to automatically disconnect a static signal after a pre-determined period of time.

Figure 1:
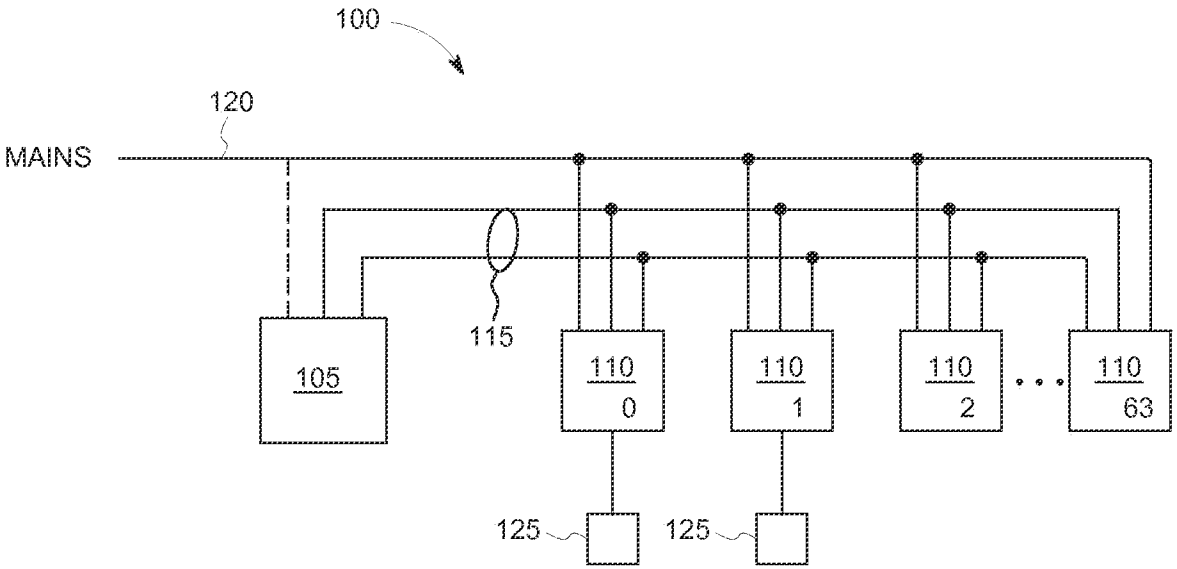
FIG. 1 PRIOR ART
FIG. 1 shows a block diagram of an exemplary digital addressable lighting interface (DALI) system.
Figure 2:
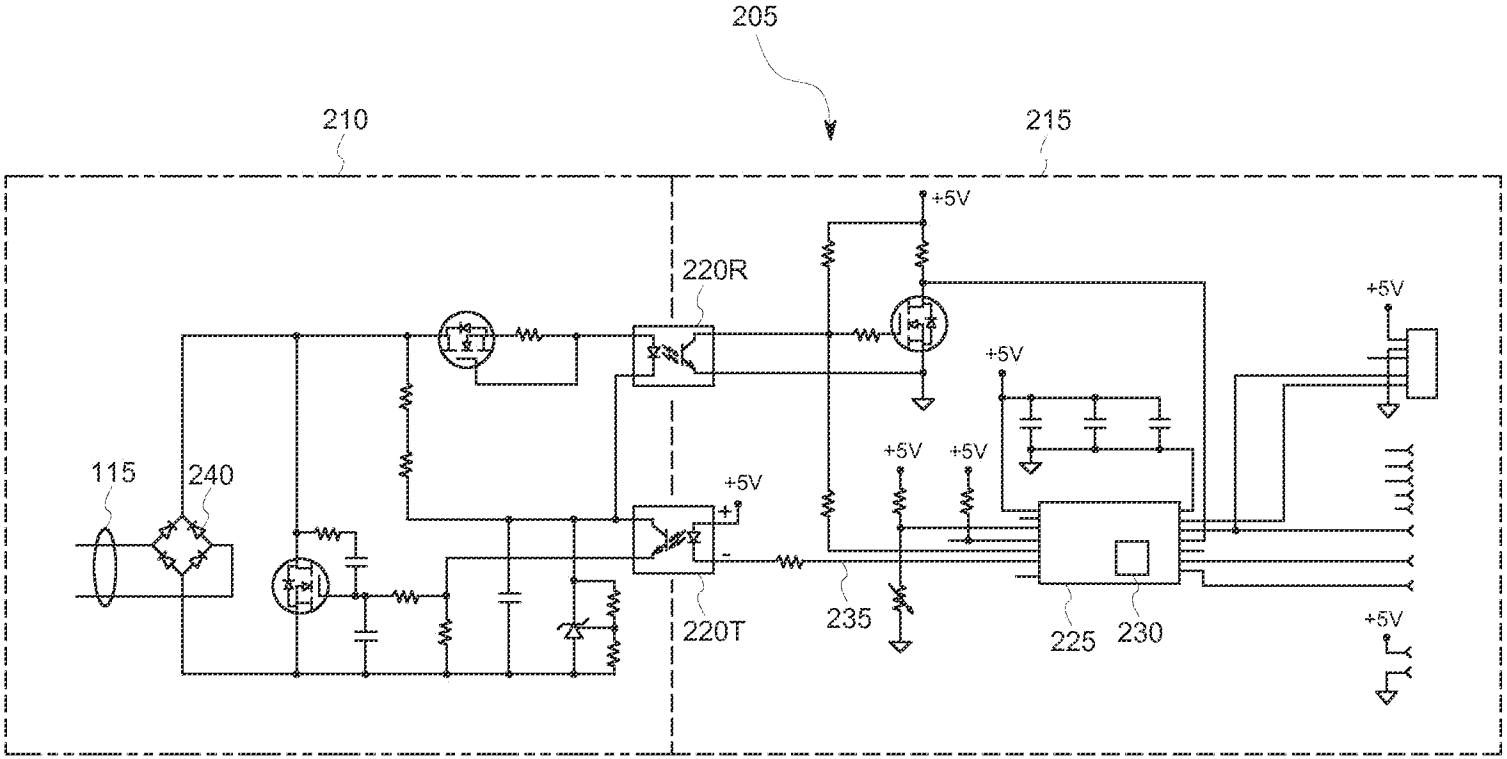
FIG. 2 PRIOR ART
FIG. 2 shows a schematic diagram of at least a portion of an exemplary DALI control gear.
Figure 3:
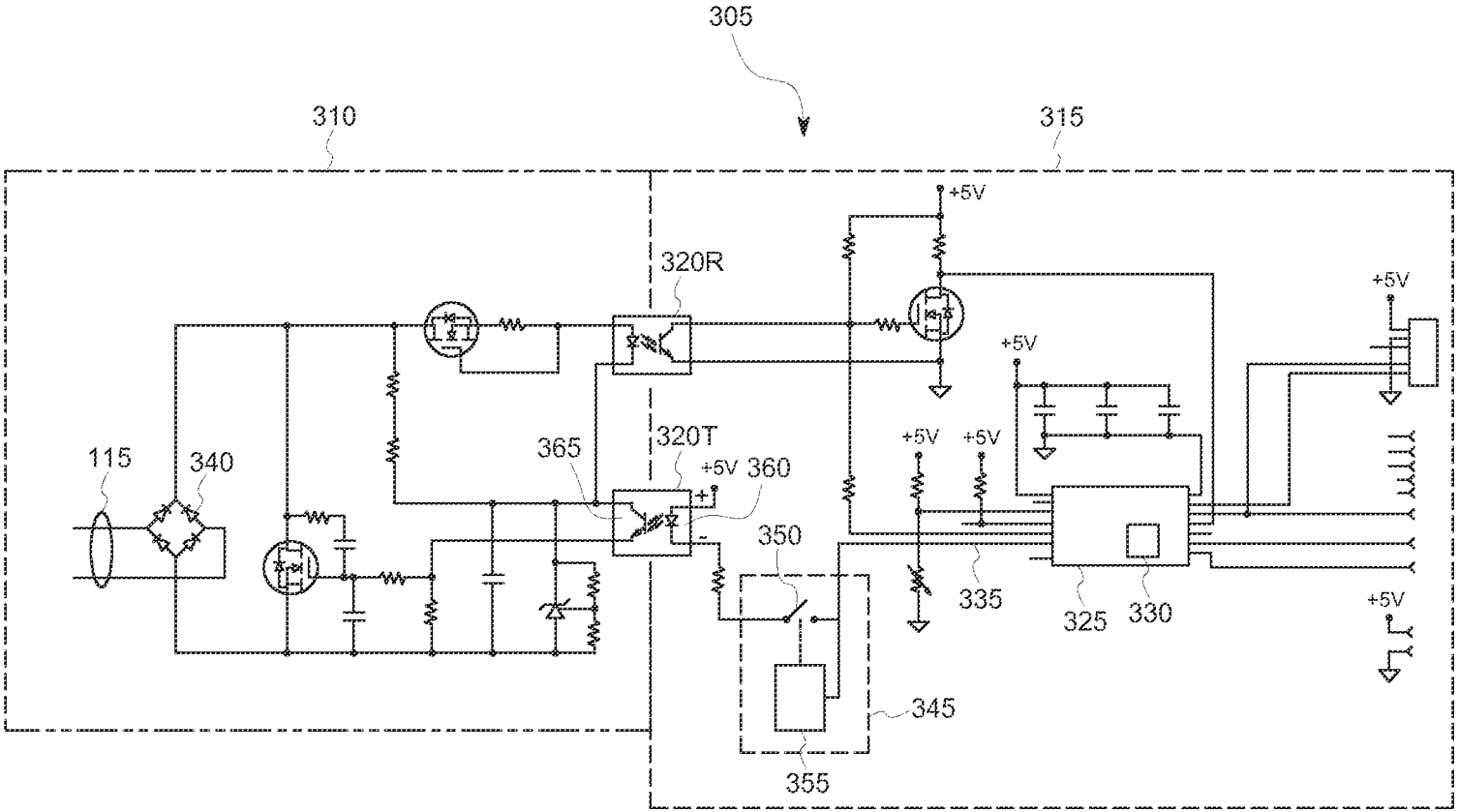
FIG. 3 is a schematic diagram of an exemplary control gear incorporating the disclosed embodiments.

FIG. 3 is a schematic diagram of an exemplary control gear 305 incorporating the structures and techniques disclosed herein. The control gear 305 may include a bus interface 310 for isolating operating circuitry 315 from the bi-directional data bus 115 using a diode bridge 340 and receiver-transmitter circuitry 360. As part of the receiver-transmitter circuitry 360, optocoupler 320R may be used for receiving commands or messages from application controller 105 to control gear 305, and optocoupler 320T may be used for transmitting responses and messages from the control gear 305 to the application controller 105.

The exemplary control gear 305 may include a computer 325, for example, a single chip microcontroller implemented as a reduced instruction computer with built in Universal Synchronous Asynchronous Receiver Transmitter (USART) capabilities. The microcontroller 325 may include a processor and a non-transitory computer readable medium in the form of a memory 330 with computer program code. The microcontroller 325 with the memory 330 and the computer program code may cause the control gear 305 to exchange commands and responses over the data bus 115 according to the disclosed embodiments, and to operate lamps and other equipment according to DALI protocol requirements. While computer or microcontroller 325 is shown and described as a programmable integrated circuit with on board memory, it should be understood that any suitable computing device may be applicable to the disclosed embodiments.

Still referring to FIG. 3, as a result of the illustrated implementation of bus interface 310, a fault causing LED 360 to remain in a constant on state causes the two wire data bus to effectively become shorted, barring communication. To remedy this, a disconnect circuit 345 may be included to limit the time that transmit output signal 335 may be held at a static level. The disconnect circuit 345 may include a switch 350 in line with transmit output signal 335, controlled by a timing circuit 355. In operation, switch 350 is normally closed. The timing circuit 355 may be triggered when transmitting optocoupler 320T of the receiver-transmitter circuit disables communication through the bidirectional bus, for example, by remaining constantly on. The timing circuit 355 may remain triggered as long as communication is disabled and after a period of time may cause switch 350 to open, disconnecting transmitting optocoupler 320T and effectively turning it off.

As an example, microcontroller 325 may experience at least one fault condition where transmit output signal 335 may be forced to a constant low level. Because transmit output signal 335 is connected to LED 360 of optocoupler 320T, LED 360 may remain continuously on causing the driver side 365 of optocoupler 320T to continuously conduct and short the two wire bi-directional data bus 115 through the diode bridge 340. If the condition persists, the two wire bi-directional data bus 115 remains inoperative, prohibiting communication between the application controller 105 and the control gear 305 or any other devices that may be connected to the bi-directional data bus 115.

In this embodiment, when transmit output signal 355 transitions to a low level, timing circuit 355 is enabled. If transmit output signal 335 is forced to remain at a low level for a predetermined period of time, timing circuit 355 times out and causes switch 350 to open. Opening switch 350 allows the voltage across LED 360 to float, causing the driver side 365 of optocoupler 220T. to go to a high impedance. The connection between the two wires of the bi-directional data bus 115 is removed and communication among devices attached to the bi-directional data bus 115 may be restored. Once the bi-directional data bus 115 is functional, the application controller 105 may begin diagnostic procedures to determine which control gear is defective and the failure cause.

Figure 4:
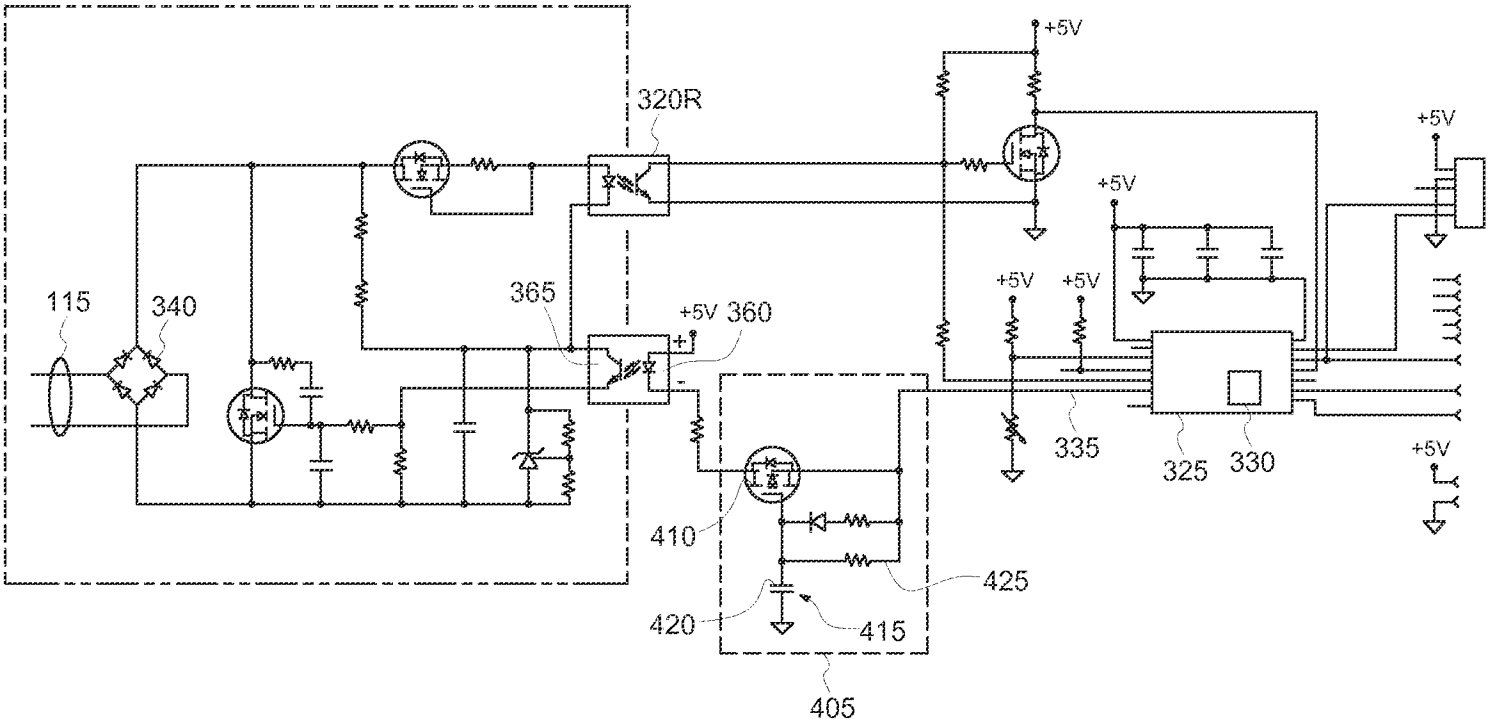
FIG. 4 shows an example of a disconnect circuit according to the disclosed embodiments.

FIG. 4 shows another example of a disconnect circuit 405. Disconnect circuit 405 may include a switch 410 implemented as a semiconductor, for example, a transistor, field effect transistor (FET), metal oxide semiconductor field effect transistor (MOSFET), or any other suitable device. In this example, a timing circuit 415 may include a capacitor 420 that discharges through a resistor 425 connected to transmit output signal 335. During normal operations capacitor 420 remains charged, causing switch 410 to conduct transmit output signal 335 to LED 360. If a fault condition forces transmit output signal 335 low for a predetermined period, capacitor 420 begins to discharge through resistor 425. If the fault condition persists, the capacitor voltage will reach a threshold level below the gate threshold of the switch 410. This results in a high impedance between the LED 360 and the transmit output signal line, effectively turning LED 360 off and removing the short between the two wires of the bi-directional data bus 115. Communication on the bi-directional data bus 115 may then be restored and diagnostics may be performed.

While described in the context of a static signal that disabled communication through a communications bus, it should be noted that the disclosed embodiments may be used to disconnect any signal that remained static for a predetermined amount of time.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Furthermore, some of the features of the exemplary embodiments could be used to advantage without the corresponding use of other features. As such, the foregoing description should be considered as merely illustrative of the principles of the disclosed embodiments and not in limitation thereof.

The invention claimed is:

1. An apparatus comprising:

a timing circuit enabled when a static signal from a controller of the apparatus disables communication through a communications bus coupled to the apparatus, the timing circuit producing a threshold level after being enabled for a predetermined time period; and a switch controlled by the timing circuit and configured to disconnect the static signal when the timing circuit produces the threshold level.

2. The apparatus of claim 1, wherein the static signal disables communication by causing a transmitter circuit coupled to the communications bus to provide a constant connection between conductors of the communications bus.

3. The apparatus of claim 1, wherein the static signal disables communication by causing a transmitter circuit coupled to the communications bus to remain constantly on.

4. The apparatus of claim 3, comprising an output of the controller of the apparatus, the output producing the static signal causing the transmitter to remain constantly on.

5. The apparatus of claim 4, wherein the switch is configured to disconnect the static signal by disconnecting the output of the controller.

6. The apparatus of claim 1, wherein the timing circuit comprises a capacitive discharge circuit for producing the threshold level.

7. The apparatus of claim 1, wherein the communications bus is a two wire bidirectional data bus.

8. The apparatus of claim 1, wherein the communications bus is a digital addressable lighting interface bus.

9. The apparatus of claim 8, further comprising a control gear coupled to the digital addressable lighting interface bus, the control gear comprising a controller with an output producing the static signal.

10. The apparatus of claim 1, the timing circuit comprising a capacitive discharge circuit to enable the timing circuit for a predetermined period of time.

11. The apparatus of claim 1, wherein the communications bus is a two wire bidirectional data bus.

12. The apparatus of claim 1, wherein the communications bus is a digital addressable lighting interface bus.

13. A method comprising:

using a static signal from a controller of an apparatus to enable a timing circuit of the apparatus upon the static signal disabling communication through a communications bus coupled to the apparatus;

allowing communication through the communication bus by disconnecting the static signal using a switch controlled by the timing circuit, after the timing circuit has been enabled for a predetermined period of time.

14. The method of claim 13, comprising enabling communication through the communication bus by disconnecting the static signal from a transmitter circuit coupled to the communications bus, preventing the transmitter circuit from providing a constant connection between conductors of the communications bus.

15. The method of claim 13, comprising enabling communication through the communication bus by disconnecting the static signal from a transmitter circuit coupled to the communications bus, preventing the transmitter circuit from remaining constantly on.

16. The method of claim 13, comprising enabling communication through the communication bus by disconnecting an output of the controller of the apparatus, the output producing the static signal causing the transmitter to remain constantly on.

17. The method of claim 13, comprising using a capacitive discharge circuit to determine that the timing circuit has been enabled for a predetermined period of time.

18. The method of claim 13, wherein the communications bus is a two wire bidirectional data bus.

19. The method of claim 13, wherein the communications bus is a digital addressable lighting interface bus.

20. A method comprising:

using a static signal to enable a timing circuit upon the static signal disabling communication through a communications bus;

allowing communication through the communication bus by disconnecting the static signal using a switch controlled by the timing circuit, after the timing circuit has been enabled for a predetermined period of time, the method further comprising enabling communication through the communication bus by disconnecting an output of a controller of a transmitter circuit, the output producing the static signal causing the transmitter to remain constantly on.

* * * * *